US007420448B2

(12) United States Patent
Takeda et al.

(10) Patent No.: US 7,420,448 B2
(45) Date of Patent: Sep. 2, 2008

(54) ELECTROMAGNETIC RELAY

(75) Inventors: Hideaki Takeda, Misato (JP); Naoya Mochizuki, Tokyo (JP)

(73) Assignee: Uchiya Thermostat Co., Ltd., Saitama-ken (JP)

( * ) Notice: Subject to any disclaimer, the term of this patent is extended or adjusted under 35 U.S.C. 154(b) by 0 days.

(21) Appl. No.: 11/449,369

(22) Filed: Jun. 8, 2006

(65) Prior Publication Data

US 2006/0226936 A1 Oct. 12, 2006

Related U.S. Application Data

(62) Division of application No. 11/036,227, filed on Jan. 14, 2005, now Pat. No. 7,187,257.

(30) Foreign Application Priority Data

Nov. 2, 2004 (JP) ..... 2004-319728

(51) Int. Cl.
*H01H 51/22* (2006.01)

(52) U.S. Cl. ..... 335/78; 335/128; 335/129

(58) Field of Classification Search ..... 335/78–86, 335/124, 128–131, 202
See application file for complete search history.

(56) References Cited

U.S. PATENT DOCUMENTS 4,683,358 A * 7/1987 Dittmann ..... 200/243
5,844,456 A 12/1998 Mader ..... 335/78
6,608,542 B2 * 8/2003 Pietsch et al. ..... 335/274
6,611,184 B2 8/2003 Hoffmann ..... 335/78
7,061,350 B2 * 6/2006 Schneider et al. ..... 335/78
2005/0264386 A1 12/2005 Chida et al. ..... 335/128

FOREIGN PATENT DOCUMENTS

JP 06-231665 8/1994
JP 10-125202 5/1998
JP 2001-093393 4/2001

* cited by examiner

*Primary Examiner*—Elvin Enad
*Assistant Examiner*—Bernard Rojas
(74) *Attorney, Agent, or Firm*—Fattibene and Fattibene; Paul A. Fattibene; Arthur T. Fattibene

(57) ABSTRACT

To provide a small-sized electromagnetic relay capable of reducing an internal resistance of a contact circuit as much as possible, and also capable of carrying a high current to the relay. The electromagnetic relay includes an electromagnetic driving block composed by a coil, an iron core, a yoke, and an armature; fixed contacts each provided on one end of each of a pair of terminals fixed to a base; and a movable spring having movable contacts provided at positions corresponding to the respective fixed contacts, the armature driving the movable spring depending on whether or not a current is carried to the coil, thereby opening or closing a contact circuit, wherein the movable spring has both ends supported by the base, the movable spring arranged in parallel to the terminals, and the movable contacts are provided on the movable spring.

7 Claims, 11 Drawing Sheets

ELECTROMAGNETIC RELAY

RELATED APPLICATION

This application is a divisional of patent application Ser. No. 11/036,227 filed Jan. 14, 2005 now U.S. Pat. No. 7,187,257, which is herein incorporated by reference in their entirety.

BACKGROUND OF THE INVENTION

1. Field of the Invention

The present invention relates to an electromagnetic relay. More specifically, the present invention relates to a small-sized electromagnetic relay improved to reduce an internal resistance of a contact circuit as much as possible and to carry a high current to the relay.

2. Description of the Related Art

A conventional small-sized electromagnetic relay of this type will be described with reference to FIG. 11. FIG. 11 is a longitudinal side view that schematically shows an electromagnetic relay 1. An electromagnetic relay 1 shown in FIG. 11 is composed by a yoke 3 built on an insulation base 2 formed by molding, an iron core 4 fixed to the yoke 3, a coil 5 wound around a bobbin (not shown) with the iron core 4 provided in a central portion of the coil 5, an armature 6 provided to be pivotally rotatable about an upper end of the yoke 3 set as a fulcrum, an insulation card 7 provided in front of a lower end of the armature 6 and longitudinally reciprocating to follow rotation of the armature 6, a movable contact piece 8 abutting on a front end of the insulation card 7, having a lower end fixed to the insulation base 2 by a longitudinal movement of the insulation card 7, and provided to be longitudinally pivotally rotatable about the lower end set as a fulcrum, a movable contact 9 provided on an outer side surface of an upper end of the movable contact piece 8, a fixed contact piece 10 provided in front of and in parallel to the movable contact piece 8, a fixed contact 11 provided in rear of an upper end of the fixed contact piece 10 to face the movable contact 9, and a cap 12 that contains the preceding constituent elements.

The electromagnetic relay 1 is constituted as follows. When a power of the coil 5 is turned on or off, the iron core 4 attracts or separates one end of the armature 6 to pivotally rotate the armature 6 about the fulcrum, and to longitudinally move the insulation card 7 on the lower end of the armature 6. In addition, to follow the longitudinal movement of the insulation card 7, the movable contact piece 8 is longitudinally pivotally rotated about its lower end set as the fulcrum, the movable contact 9 provided on the movable contact piece 8 comes in contact with or separates from the fixed contact 11, thereby opening or closing the movable contact 9 and the fixed contact 11.

The movable contact piece 8 has a cantilever structure having the lower end fixed to the insulation base 2. Therefore, the electromagnetic relay of this type is employed if a current capacity is not very large (For example, Japanese Patent Application Laid-open Nos. H6-231 665, H 10-125202, and 2001-93393, respectively).

According to this conventional technique, since the movable contact piece 8 needs to be constituted by a spring plate, an internal resistance of a contact circuit cannot be set low. With a structure in which the movable contact 9 is attached to the movable contact piece 8 so as to reduce the resistance, and in which the movable contact piece 8 is set to have a large thickness and supported by the cantilever spring, the conventional electromagnetic relay disadvantageously, sometimes malfunctions when an impact is applied since the movable contact 9 having a heavy tip end is fixedly provided.

SUMMARY OF THE INVENTION

It is, therefore, an object of the present invention to provide a small-sized electromagnetic relay capable of reducing an internal resistance of a contact circuit as much as possible, and also capable of carrying a high current to the relay.

To attain this object, a first aspect of the present invention provides an electromagnetic relay including: an electromagnetic driving block composed by a coil, an iron core, a yoke, and an armature; fixed contacts each provided on one end of each of a pair of terminals fixed to a base; and a movable spring having movable contacts provided at positions corresponding to the respective fixed contacts, the armature driving the movable spring depending on whether or not a current is carried to the coil, thereby opening or closing a contact circuit, wherein the movable spring has both ends supported by the base, the movable spring arranged in parallel to the terminals, and in that the movable contacts are provided on the movable spring. Therefore, the internal resistance of the contact circuit can be reduced as much as possible, and the high current can be carried to the relay.

A second aspect of the present invention provides the electromagnetic relay according to the first aspect, wherein the movable contacts are provided on the movable plate thicker than the movable spring, consisting of a copper or a copper alloy, and having a low specific resistance, at least two points of the movable plate are fixed to the movable spring, and in that the pair of fixed contacts, the movable contacts corresponding to the respective fixed contacts, and the movable spring supporting the movable plate are arranged on a line.

A third aspect of the present invention provides an electromagnetic relay, wherein a pair of fixed contacts, a movable plate including movable contacts corresponding to the respective fixed contacts, and a movable spring supporting the movable plate are arranged on a line, both ends of the movable spring are loosely fitted into upper ends of columns provided on a base on an extension orthogonal to the line, thereby constituting fulcrums of the movable spring, respectively, an armature drives the movable spring at an intermediate between each of two fixed points of the movable plate and the fulcrum on each of the columns of the base, thereby opening or driving a contact circuit, and the armature forces down the intermediate after the fixed contacts contact with the respective movable contacts, whereby an inward flexion is generated between each of the movable contacts and each of the columns, and a wipe operation can be carried out in portions in which the fixed contacts contact with the respective movable contacts. Therefore, contact stability of the contacts can be ensured.

A fourth aspect of the present invention provides an electromagnetic relay having a two-pole configuration, including: two pairs of terminals; two pairs of fixed contacts provided on horizontal portions of the respective terminals; two movable springs on each of which a pair of movable contacts are provided at positions corresponding to each pair of the two pairs of fixed contacts; and an insulation pressing plate provided on the movable springs, an armature driving the insulation pressing plate depending on whether or not a current is carried to a coil, thereby opening or closing two contact circuits, wherein each of the movable springs has both ends supported by a base, the pressing plate consists of a spring plate, and when the armature drives the pressing plate, the armature forces down the pressing plate after the fixed contacts contact with the respective movable contacts, whereby the pressing plate generates inward flexions of the two movable springs on each of which the pair of movable contacts are arranged in parallel, and a wipe operation can be carried out in portions in which the four movable contacts contact with the respective four fixed contacts.

A fifth aspect of the present invention provides an electromagnetic relay including: an electromagnetic driving block composed by a coil, an iron core, a yoke, and an armature; fixed contacts each provided on one end of each of a pair of terminals fixed to a base; and a movable plate having movable contacts provided at positions corresponding to the respective fixed contacts, the movable plate attached to a movable spring, the armature driving the movable spring depending on whether or not a current is carried to the coil, thereby opening or closing a contact circuit, wherein fixing means for fixing the movable spring of the two-pole relay is constituted so that both ends of the movable spring are inserted into slits insulated from the terminals and provided on a base, respectively, thereby fixing the movable spring while the both ends are supported, the movable plate provided with the movable contacts is fixed to a displacement center of the movable spring, and bent portions are provided on both sides of the movable spring, respectively, so that the movable plate can be moved in parallel to a surface of the base.

A sixth aspect of the present invention provides an electromagnetic relay including fixing means for fixing the movable spring constituted so that both ends of the movable spring are fixed to the electromagnetic driving block, preferably the yoke, the movable plate provided with the movable contacts is fixed to a displacement center of the movable spring, and bent portions are provided on both sides of the movable spring, respectively, so that the movable plate can be moved in parallel to a surface of the base.

With a view of ensuring the contact stability of the contacts even in the two-pole relay, a seventh aspect of the present invention provides the electromagnetic relay according to the fifth or the sixth aspect, wherein the electromagnetic relay includes two the contact circuits, an insulation pressing plate having a spring property is provided on the movable springs including movable plates to which two pairs of movable contacts are attached, respectively, and when the armature drives the pressing plate, the armature forces down the pressing plate after the fixed contacts contact with the respective movable contacts, whereby the pressing plate generates inward flexions of the two movable springs on each of which the pair of movable contacts are arranged in parallel, and a wipe operation can be carried out in portions in which the four movable contacts contact with the respective four fixed contacts.

There is also a demand of an electromagnetic relay having one circuit and gaps among three contacts. To meet this demand, an eighth aspect of the present invention provides an electromagnetic relay including: an electromagnetic driving block composed by a coil, an iron core, a yoke, and an armature; first, second, and third terminals fixed to a base; fixed contacts provided at positions that generally form a triangle on an upper surface of the base; a first movable plate having movable contacts provided at positions corresponding to two of the three fixed contacts, respectively, the first movable plate provided to coincide with a line that connects the two fixed contacts; and a movable contact corresponding to the other fixed contact, and provided in a central portion of a second movable plate parallel to the first movable plate, wherein the first movable plate and the second movable plate are fixed to a pressing plate exhibiting a conductive property and a spring property, the first movable plate and the second movable plate are attached to a movable spring having both ends supported so that center lines of the movable plates coincide with a center line of the movable spring, and in that the armature drives the pressing plate depending on whether or not a current is carried to the coil, thereby opening or closing a contact circuit. That is, the electromagnetic relay is constituted so that the gaps among the three contacts operate as two contact blocks when the three movable contacts are simultaneously closed.

Likewise, a ninth aspect of the present invention provides an electromagnetic relay including: an electromagnetic driving block composed by a coil, an iron core, a yoke, and an armature; first, second, and third terminals fixed to a base; fixed contacts provided at positions that generally form a triangle on an upper surface of the base; movable contacts provided at positions corresponding to the respective fixed contacts on a movable plate exhibiting a spring property; a first rib provided outside of the movable contacts at the positions corresponding to two of the three fixed contacts on the movable plate so as to be parallel to a line that connects the two fixed contacts; a second rib provided at a position outside of the movable contact corresponding to the other fixed contact on the movable plate so as to be parallel to the first rib; and spring portions provided on the line so as to support both ends of the movable plate, wherein the armature drives the movable plate depending on whether or not a current is carried to the coil, thereby opening or closing a contact circuit. By so constituting, the same functions as those of the invention according to the eighth Aspect can be exhibited by the ribs while simplifying the movable plate.

To make the wipe operation clearer, a tenth aspect of the present invention provides the electromagnetic relay according to any one of the third to the ninth aspects, wherein the center line of the movable plate including the movable contacts provided to correspond to the line that connects the two fixed contacts and the center line of the movable spring to which the movable plate is attached are slightly offset inward, preferably offset inward in a range of a length equal to or smaller than a half of a contact diameter.

An eleventh aspect of the present invention provides an electromagnetic relay that is a small-sized relay having a pair of terminals fixed to a base for intensifying a fixing strength of each terminal and a strength of the base, wherein each of the terminals fixed to the base is composed by a portion extending on a surface of the base, a portion formed by bending one end of the extending portion at a right angle so as to be pulled outside of the base as an external terminal, and a portion formed by bending the other end of the extending portion at the right angle so as to be penetrated and inserted into the base, at least one through hole, which is exposed to outside when each of the terminals are inserted into the base, is provided in one of the portions of the each terminal, after the each terminal is inserted into the through hole, an adhesive is poured into the through hole, thereby fixing the each terminal to a bottom of the base, a portion of the base which is opposite to the through hole, and into which the other end of the each terminal is inserted is hardened by the adhesive, whereby a fixing strength of the each terminal and a strength of the base are secured.

BRIEF DESCRIPTION OF THE DRAWINGS

FIG. 1 C is a cross-sectional view taken along a line B-B of FIG. 1 A;

FIG. 1 E is a plan view of an insulation base;

FIG. 1 F is a circuit diagram of the electromagnetic relay having the circuit and the gap between two contacts shown in FIG. 1A;

DESCRIPTION OF THE PREFERRED EMBODIMENTS

The present invention achieves the object of reducing the internal resistance of the contact circuit as much as possible and enabling carrying a high current to the relay by providing an electromagnetic relay electromagnetic relay comprising: an electromagnetic driving block composed by a coil, an iron core, a yoke, and an armature; fixed contacts each provided on one end of each of a pair of terminals fixed to a base; and a movable spring having movable contacts provided at positions corresponding to the respective fixed contacts, the armature driving the movable spring depending on whether or not a current is carried to the coil, thereby opening or closing a contact circuit, wherein the movable spring has both ends supported by the base, the movable spring arranged in parallel to the terminals, and the movable contacts are provided on the movable spring.

Figure 1A:
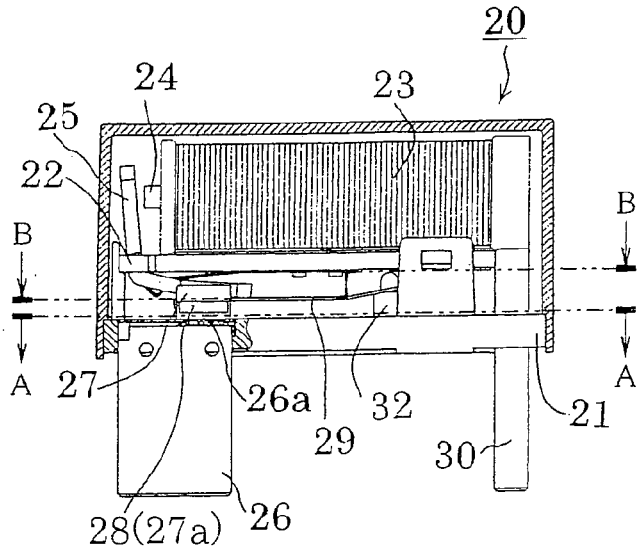
FIG. 1A is a longitudinal side view of an electromagnetic relay having one circuit and a gap between two contacts according to one embodiment of the present invention.
Figure 4A:
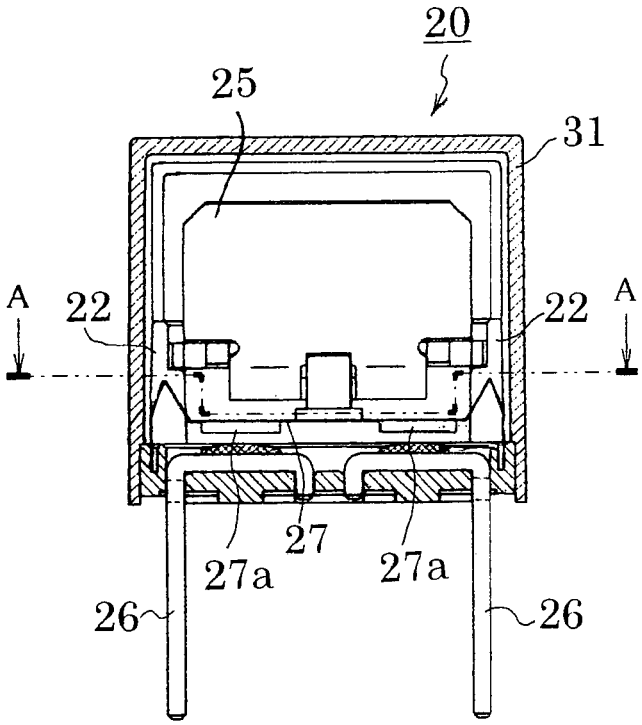
FIG. 4A is a longitudinal front view of a movable spring support structure of the electromagnetic relay.
Figure 4B:
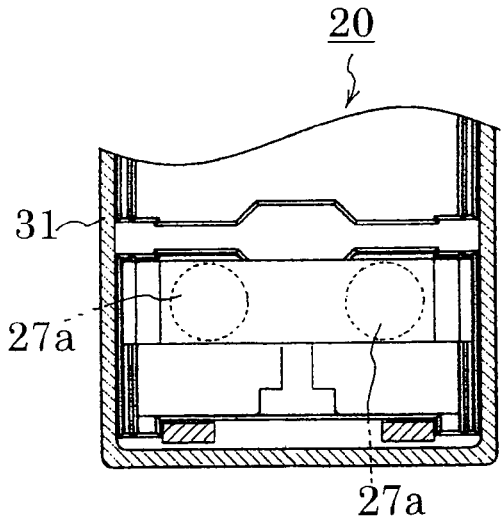
FIG. 4B is a partially cut plan view that shows an enlarged view of important parts of FIG. 4A.

With reference to FIGS. 1A to 1F (in which an electromagnetic relay that includes a movable plate, to be described later, also serving as a movable contact is shown) and FIGS. 4A and 4B (in which an electromagnetic relay that does not includes a movable plate is shown), a reference symbol 20 denotes an electromagnetic relay according to the present invention. The electromagnetic relay 20 is composed by an insulation base 21 formed by molding, a yoke 22, a coil 23, an iron core 24, an armature 25, terminals 26, fixed contacts 26*a* provided on the respective terminals 26, a movable spring 27, a movable plate 28 supported by the movable spring 27, movable contacts 27*a* provided on the movable plate 28 to be connected with or disconnected from the respective fixed contacts 26*a*, an elastic plate 29 elastically releasing pressurization on the movable spring 27, a coil terminal 30, and a cap 31. As shown in FIGS. 1A to 1F, the electromagnetic relay 20 is an embodiment of a relay having one circuit and a gap between two contacts. FIG. 1A is a longitudinal side view of the electromagnetic relay 20, FIG. 1 B is a cross-sectional view taken along a line A-A of FIG. 1A, FIG. 1 C is a cross-sectional view taken along a line B-B of FIG. 1A, FIG. 1 D is a longitudinal front view of FIG. 1A, FIG. 1 E is a plan view of the insulation base 21, and FIG. 1 F is a circuit diagram of the electromagnetic relay 20.

The electromagnetic relay 20 is constituted so that the armature 25 drives the movable spring 27 through the elastic plate 29 depending on whether or not a current is carried to the coil 23, and so that the movable contacts 27*a* are connected to or disconnected from the respective fixed contacts 26*a* to thereby open or close a contact circuit.

As shown in FIG. 1A, the coil 23 is supported by the yoke 22, and the armature 25 which is rotated about a left end of the yoke 22 set as a fulcrum is provided, thus forming an electromagnetic driving block. A tip end of the elastic plate 29, shown in FIG. 1 C, having a right end supported by a protrusion piece 32 protruding from the insulation base 21 and a supported left end serving as a rotation base point is moved downward to follow a pressurization return operation of the armature 25. Following the downward movement of the tip end of the elastic plate 29, the movable spring 27 having a central portion stopped by the tip end of the elastic plate 29 is elastically deformed and vertically moved, whereby the movable contacts 27*a* provided on a lower surface of the movable plate 28 supported by the movable spring 27 is connected with or disconnected from the respective fixed contacts 26*a* provided on the terminals 26.

Figure 1D:
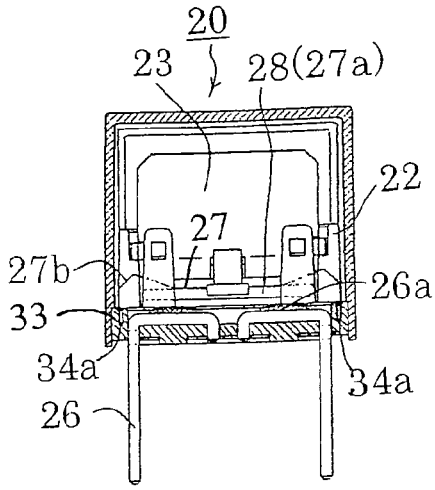
FIG. 1D is a longitudinal front view of FIG. 1A.
Figure 1B:
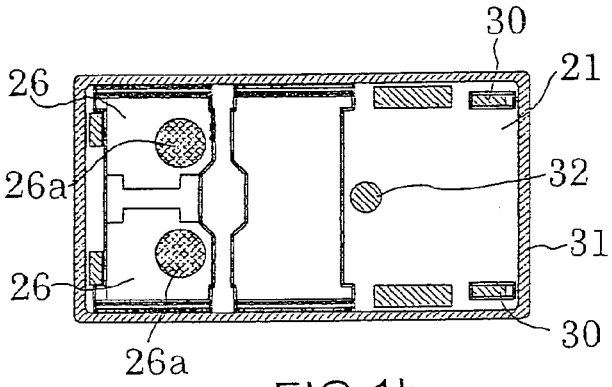
FIG. 1 B is a cross-sectional view taken along a line A-A of FIG. 1 A.
Figure 1E:
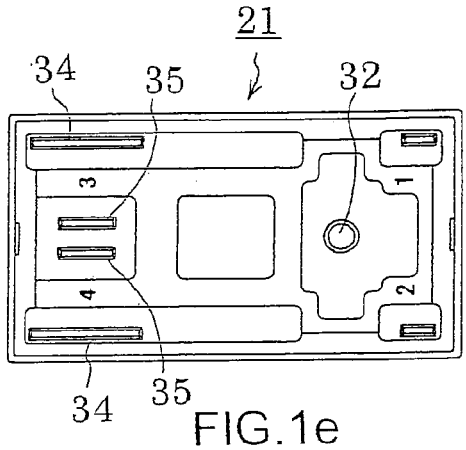
Figure 1C:
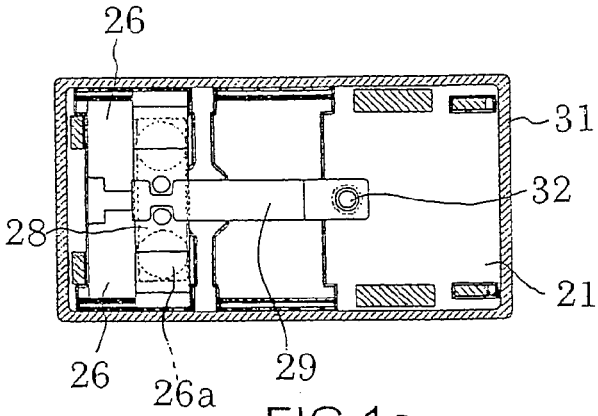
Figure 1F:
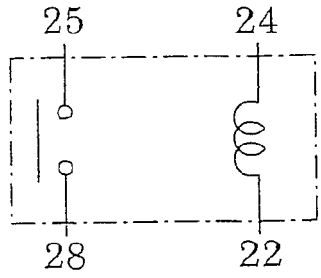

As shown in FIG. 1D, the movable spring 27 has both ends 27*b* horizontally extending in a lateral direction so that the both ends are fitted into slits 34*a* formed in columns 33 protruding from both ends of the insulation base 21, respectively, and are thereby supported. The movable contacts 27*a* are provided to face the respective fixed contacts 26*a*.

Each terminal 26 is formed into an inverse concave having one piece as a long piece 26*b* and the other piece as a short piece 26*c*. The short piece 26*c* is fixedly fitted into a central slit 34 provided in the insulation base 21, the long piece 26*c* is inserted into an insertion hole 35 formed in the each end of the insulation base 21, and a remainder of the long piece 26C protrudes to an outside of the insulation base 21. A horizontal portion 26*d* of the inverse concave terminal 26 extends onto the insulation base 21, and each fixed contact 26*a* is provided on the horizontal portion 26*d*.

Figure 5A:
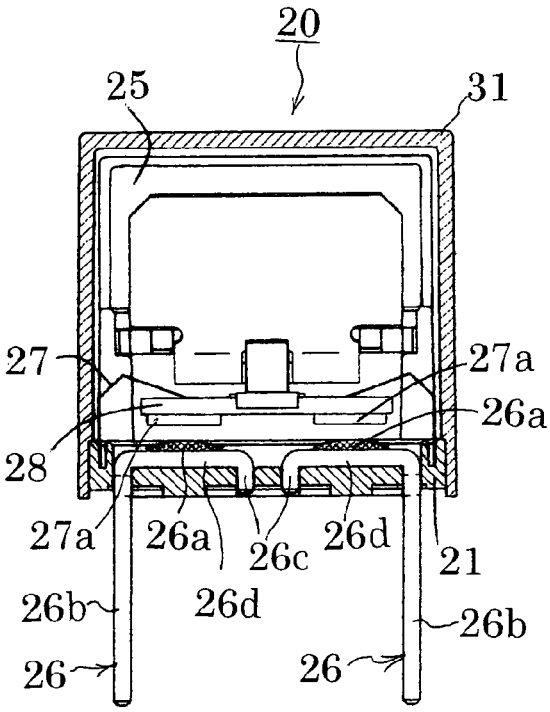
FIG. 5A is a longitudinal front view which shows arrangement positions of a movable plate and movable contacts of the electromagnetic relay in a state in which the contacts are opened.
Figure 5B:
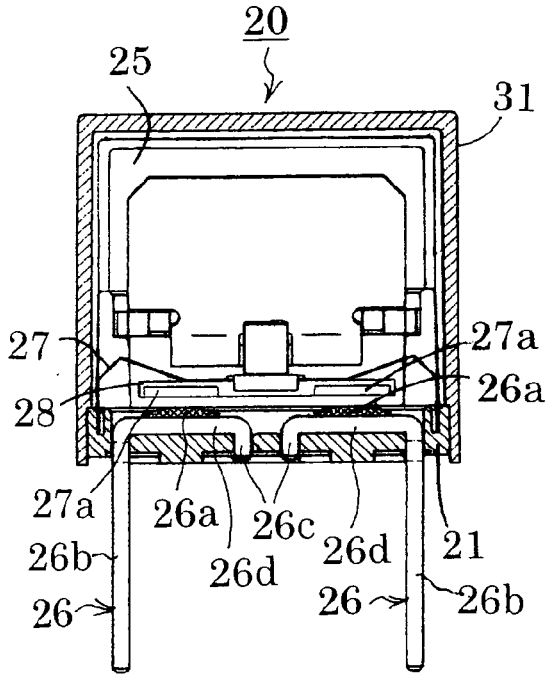
FIG. 5B is a longitudinal front view which shows an inlay material (a material having two materials laminated)

FIGS. 5A and 5B show a configuration of the electromagnetic relay 20 to explain that a high current is carried to turn on the contact circuit. In FIGS. 5A and 5B, the movable plate 28 formed to be thicker than the movable spring 27 and made of a copper or a copper alloy having a low specific resistance is shown. The movable plate 28 is provided with the movable contacts 27*a* and at least two points of the movable plate 28 are fixed to the movable spring 27. The paired of fixed contacts 26*a*, the movable contacts 27*a* facing the respective fixed contacts 26*a*, the movable plate 28 provided with the movable contacts 27*a*, and the movable spring 27 are arranged on a line.

Further, as shown in FIGS. 1 A to 1 F, the paired fixed contacts 26*a*, the movable plate 28 provided with the movable contacts 27*a* facing the respective fixed contacts 26*a*, and the movable spring 27 are arranged on a line. Both ends of the movable spring 27 are loosely fitted into upper ends of the columns 33 provided on the insulation base 2*i* on an extension orthogonal to the line, thereby constituting elastic deformation fulcrums of the movable spring 27, respectively. The armature 25 drives the movable spring 27 at an intermediate between each of the two fixed points of the movable plate 28 and the fulcrum of the movable spring 27 on each column 33, thereby opening or closing the contact circuit. After the fixed contacts 26*a* contact with the respective movable contact 27*a*, the armature 25 forces down the movable spring 27. As a result, an inward flexion is generated between each movable contact 27*a* and each column 33, whereby a wipe operation is carried out in portions in which the two movable contacts 27*a* contact with the respective two fixed contacts 26*a*.

Figure 2A:
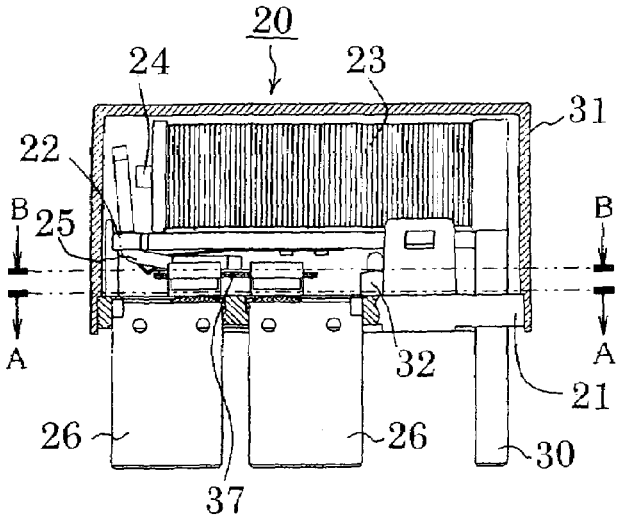
FIG. 2A is a longitudinal side view of an electromagnetic relay having two circuits and a gap between two contacts per circuit according to another embodiment of the present invention.
Figure 2D:
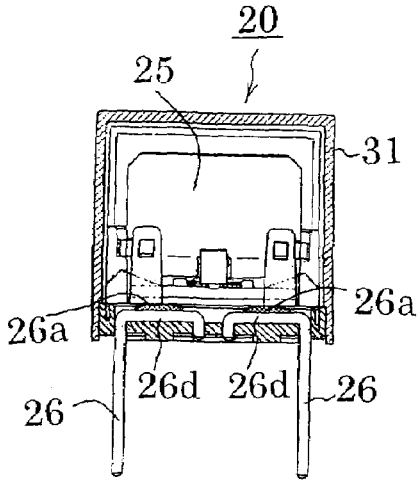
FIG. 2D is a longitudinal front view of FIG. 2A.
Figure 2B:
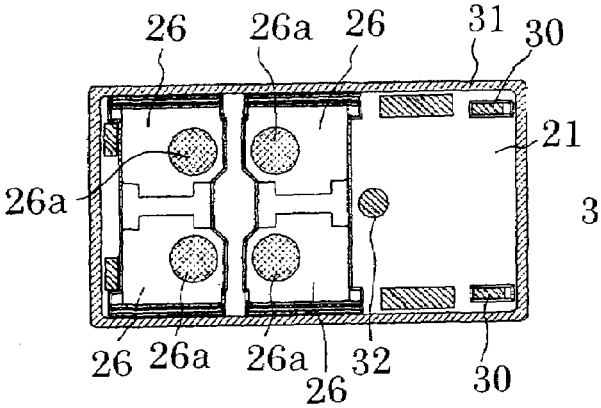
FIG. 2B is a cross-sectional view taken along a line A-A of FIG. 2A.
Figure 2E:
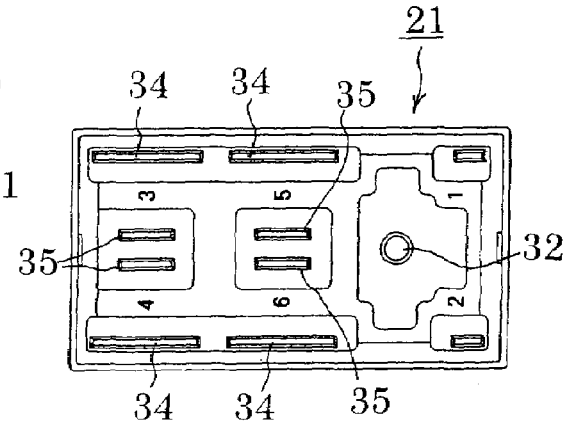
FIG. 2E is a plan view of an insulation base.
Figure 2C:
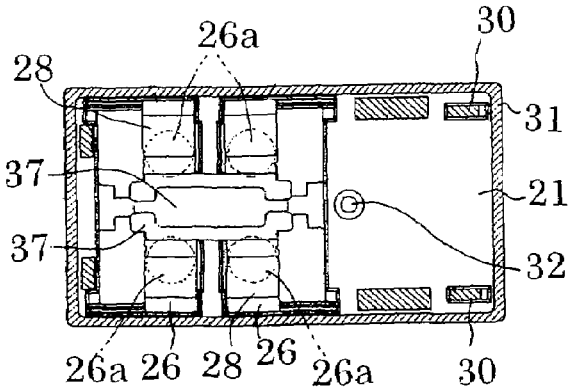
FIG. 2C is a cross-sectional view taken along a line B-B of FIG. 2A.
Figure 2F:
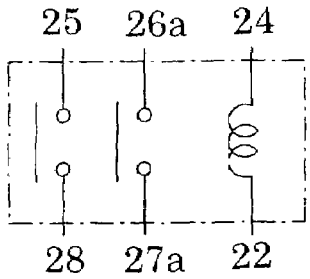
FIG. 2F is a circuit diagram of the electromagnetic relay having the two circuits and the gap between two contacts shown in FIG. 2A.

FIGS. 2A to 2F disclose an electromagnetic relay 20 having two circuits and a gap between two contacts per circuit, as typically shown in the circuit diagram of FIG. 2F. As shown in FIGS. 2A to 2F, the electromagnetic relay 20 includes two pairs of terminals 26, two pairs of fixed contacts 26*a* provided on horizontal portions 26*d* of the respective terminals 26, and two movable springs 27 to each of which a movable plate 28 serving as a pair of movable contacts 27*a* is fixed, and which are arranged at positions facing the respective pairs of fixed contacts 26*a*. An insulation pressing plate 37 consisting of a material having two types of laminated inlay materials laminated is provided on the movable springs 27. An armature 25 drives the insulation pressing plate 37 depending on whether or not a current is carried to a coil 23, thereby opening or closing two contact circuits. The insulation pressing plate 37 is constituted by a spring plate. When the armature 25 drives the insulation pressing plate 37, the armature 25 forces down the insulation pressing plate 37 after the fixed contacts 26*a* contact with the respective movable contacts 27*a*. The insulation pressing plate 37 generates inward flexions of the two movable springs 27 on each of which the two movable contacts 27*a* are arranged in parallel, whereby a wipe operation is carried out in portions in which the four movable contacts 27*a* contact with the respective four fixed contacts 26*a*.

Figure 6A:
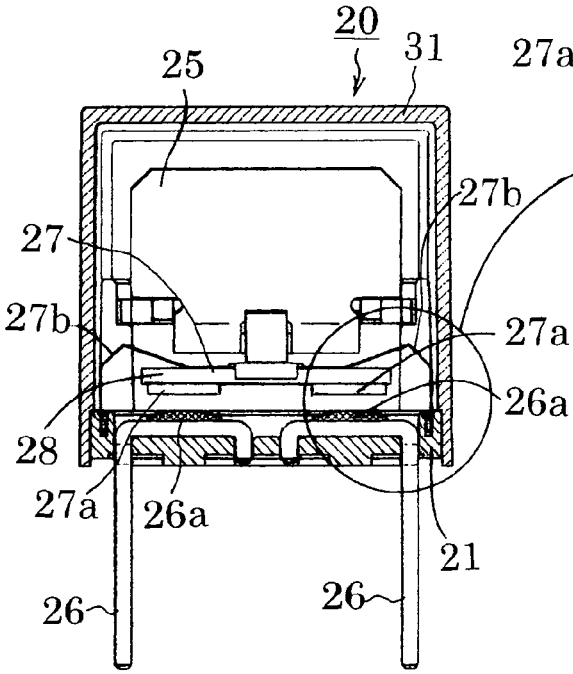
FIG. 6A is a longitudinal front view which shows a state in which the movable spring of the electromagnetic relay is fixed to the insulation base.
Figure 6B:
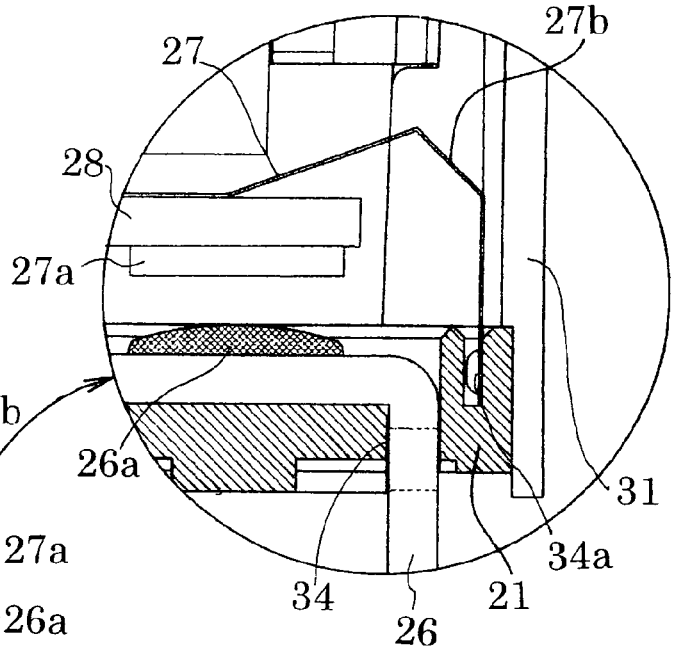
FIG. 6B is an enlarged view of a part in a circle shown in FIG. 6A.

FIG. 6A and GB show fixing means for fixing the movable spring 27. Namely, the both ends of the movable spring 27 are inserted into slits 34*a* insulated from the terminals 26, and provided on the both ends of the insulation base 21, respectively. The movable spring 27 is thereby fixed while the both ends thereof are supported. The movable plate 28 provided with the movable contacts 27*a* is fixed to a displacement center of the movable spring 27. Bent portions 27*b* are provided on both sides of the movable spring 27, respectively, so that the movable plate 28 can be moved in parallel to a surface of the insulation base 21.

Figures 7A, 7B:
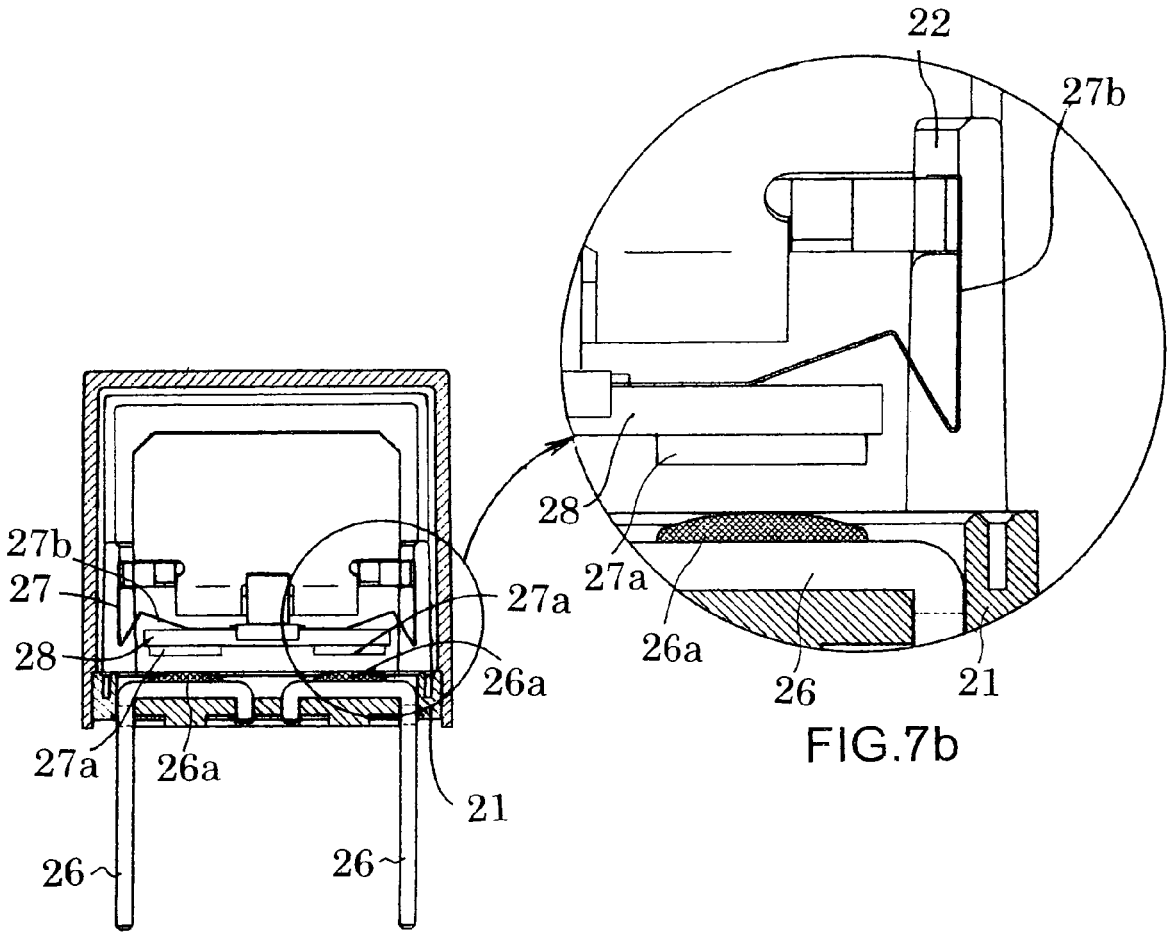
FIG. 7A is a longitudinal front view which shows a state in which the movable spring of the electromagnetic relay is fixed to a yoke.
FIG. 7B is an enlarged view of a part in a circle shown in FIG. 7A.
Figure 8A:
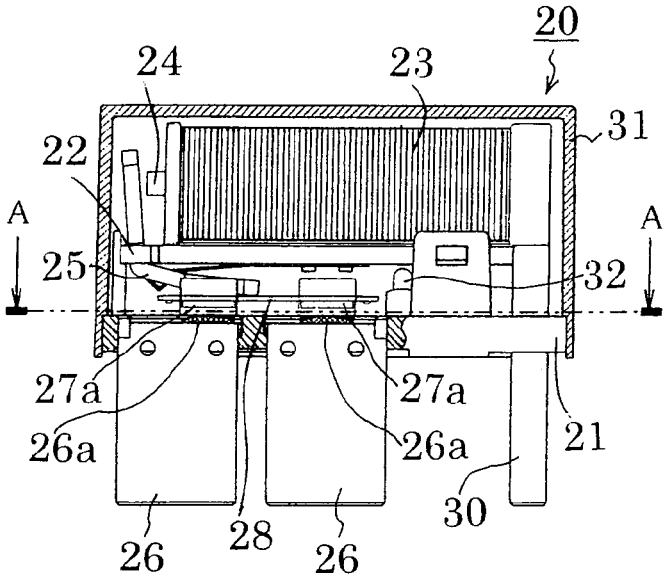
FIG. 8A is a longitudinal side view of an electromagnetic relay having one circuit and gaps among three contacts according to yet another embodiment of the present invention.
Figure 8D:
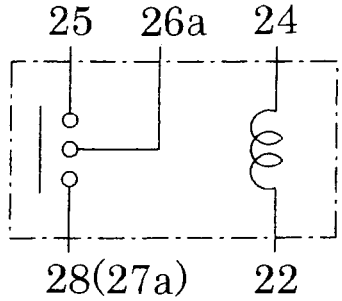
FIG. 8D is a circuit diagram of the electromagnetic relay shown in FIG. 8A.
Figure 8E:
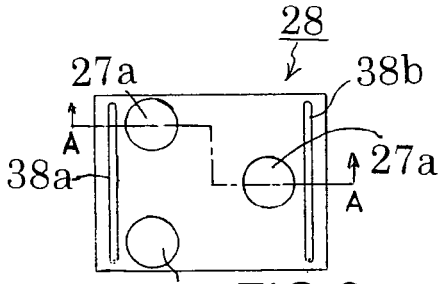
FIG. 8E is a plan view which shows a state in which ribs are provided on a movable plate.
Figure 8B:
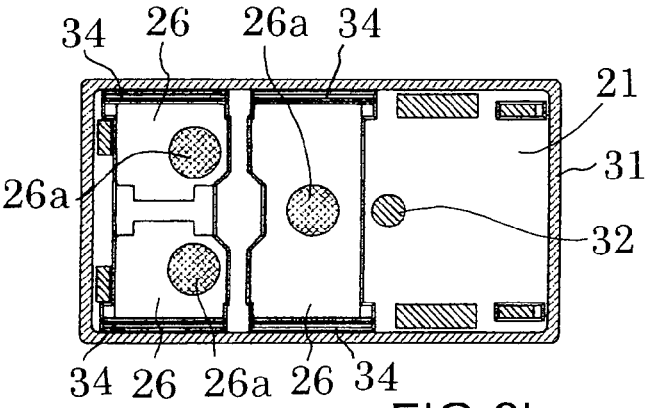
FIG. 8B is a cross-sectional view taken along a line A-A of FIG. 8A.
Figure 8F:
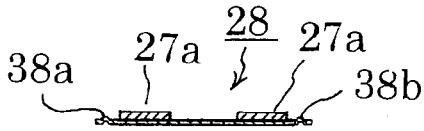
FIG. 8F is a longitudinal front view of FIG. 8E.
Figure 8G:
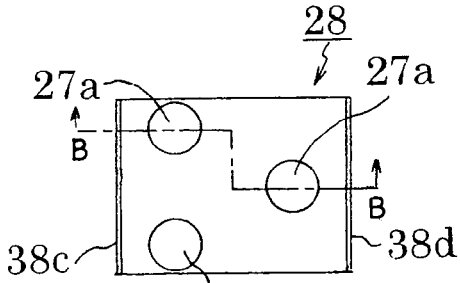
FIG. 8G is a plan view which shows a state in which a protrusion edges are provided on the movable plate.
Figure 8C:
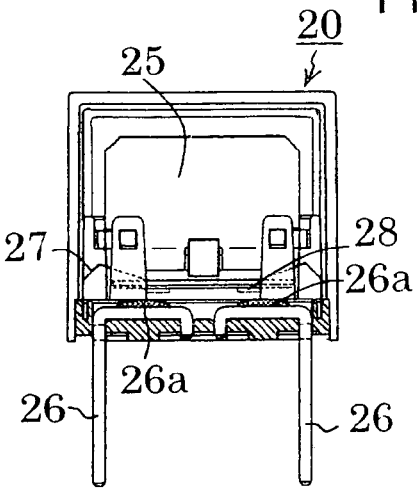
FIG. 8C is a longitudinal front view of FIG. 8A.
Figure 8H:
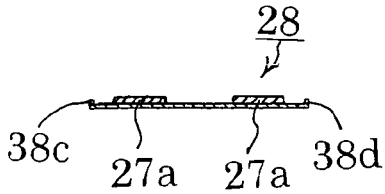
FIG. 8H is a longitudinal front view of FIG. 8G.
Figure 9A:
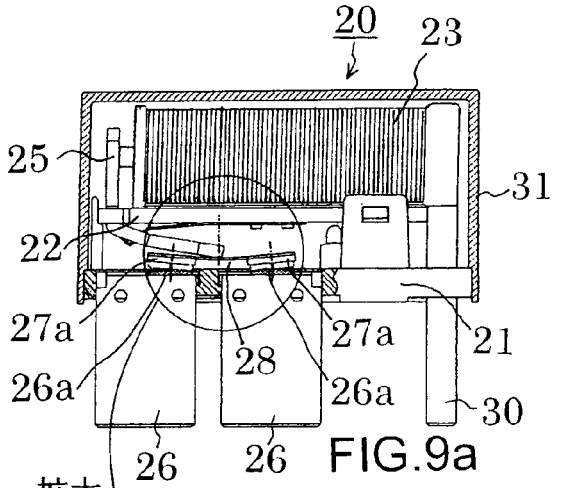
FIG. 9A is a longitudinal side view which shows a basic operation of a contact wipe.
Figure 9B:
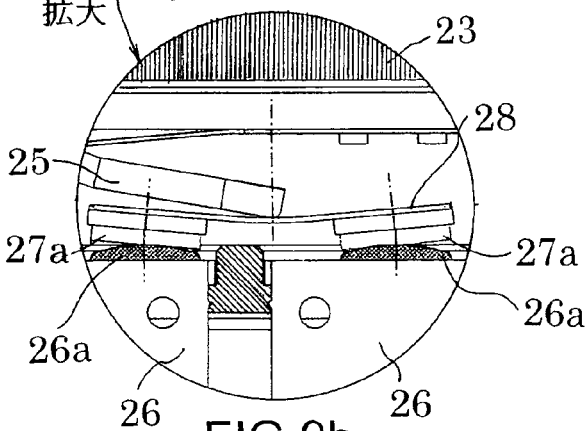
FIG. 9B is an enlarged view of a part in a circle shown in FIG. 9A.
Figure 9D:
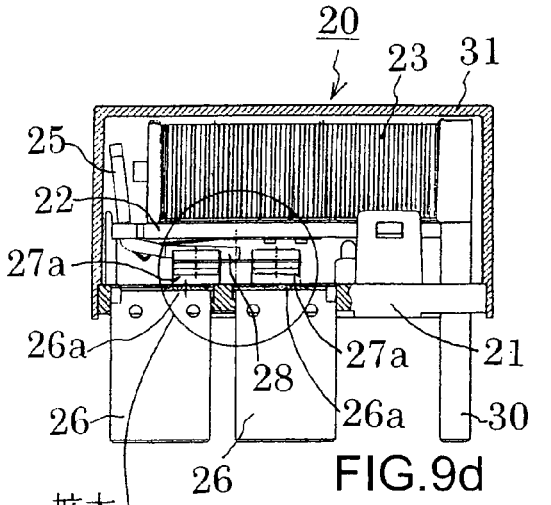
FIG. 9D is a longitudinal side view which shows an applied example of offsetting a contact center.
Figure 9E:
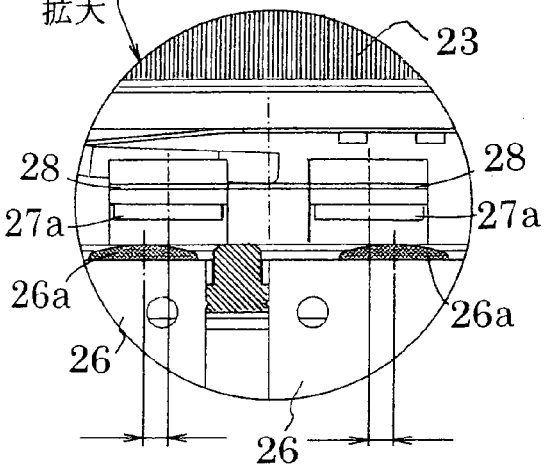
FIG. 9E is an enlarged view of a part in a circle shown in FIG. 9D.
Figure 9C:
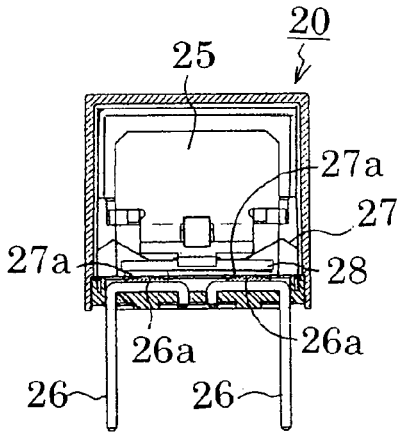
FIG. 9C is a longitudinal front view of FIG. 9A.
Figure 9F:
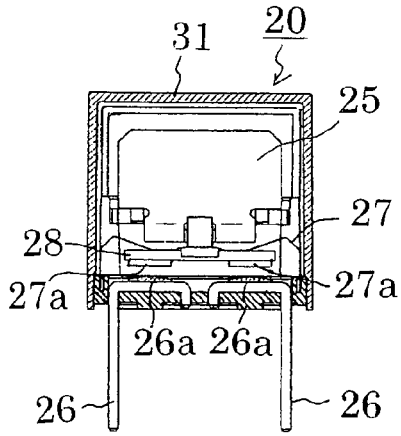
FIG. 9F is a longitudinal front view of FIG. 9D.

FIGS. 7A and 7B show another fixing means for fixing the movable spring 27. Namely, the movable spring 27 is fixed to the yoke 22. While FIGS. 7A and 7B show a state in which the both ends of the movable spring 27 are fixed to the yoke 22, the both ends of the movable spring 27 may be fixed to the member other than the yoke 22 as long as the member belongs to the electromagnetic driving block constituted by the yoke 22, the coil 23, the iron core 24, the armature 25, and the like. The movable plate 28 provided with the movable contacts 27*a* is fixed to a displacement center of the movable spring 27. Bent potions 27*b* are provided on both sides of the movable spring 27, respectively, so that the movable plate 28 can be moved in parallel to a surface of the insulation base 21.

FIGS. 2A to 2F disclose the electromagnetic relay 20 having two circuits and a gap between the two contacts per circuit. The electromagnetic relay 20 includes two contact circuits. The insulation pressing plate 37 exhibiting a spring property is provided on the movable springs 27 to which the movable plate 28, to which the two pairs of movable contacts 27*a* are attached, is fixed. When the armature 25 drives the insulation pressing plate 37, the armature 25 forces down the insulation pressing plate 37 after the fixed contacts 26*a* contact with the respective movable contacts 27*a*. The inward flexions of the two movable springs 27 on each of which the two movable contacts 27*a* are arranged in parallel, whereby a wipe operation is carried out in portions in which the four movable contacts 27*a* contact with the respective four fixed contacts 26*a*.

Figure 3A:
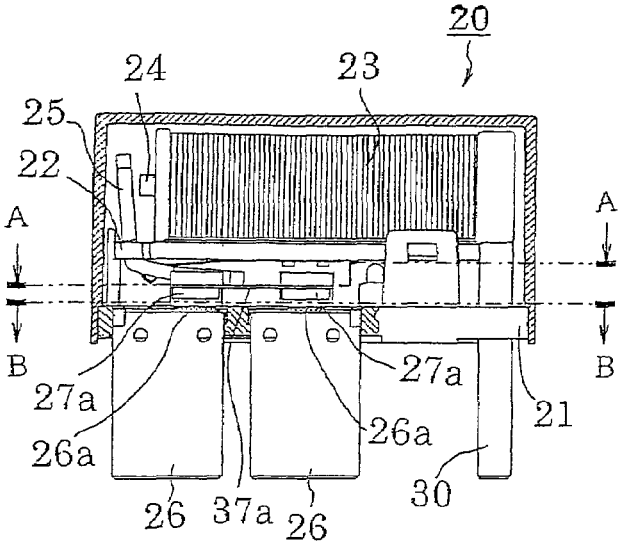
FIG. 3A is a longitudinal side view of an electromagnetic relay having one circuit and gaps among three contacts according to yet another embodiment of the present invention.
Figure 3D:
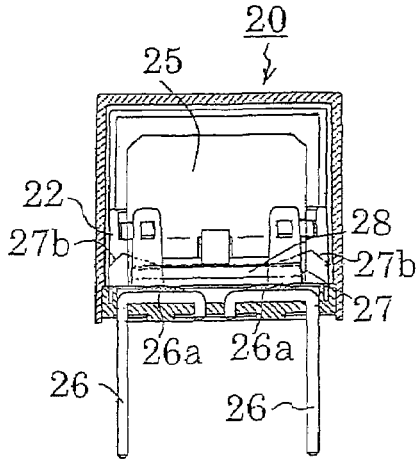
FIG. 3D is a longitudinal front view of FIG. 3A.
Figure 3B:
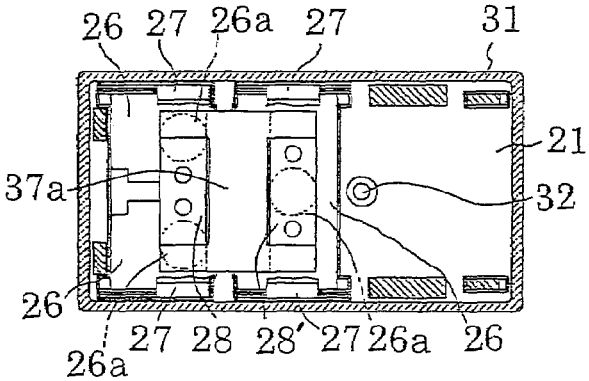
FIG. 3B is a cross-sectional view taken along a line A-A of FIG. 3A.
Figure 3E:
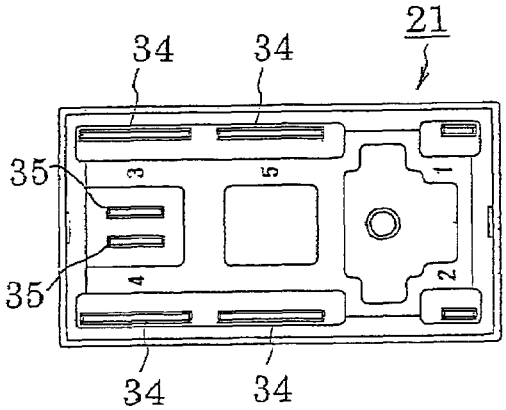
FIG. 3E is a plan view of an insulation base.
Figure 3C:
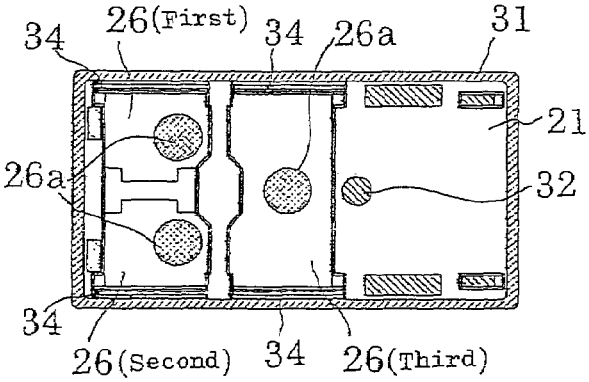
FIG. 3C is a cross-sectional view taken along a line B-B of FIG. 3A.
Figure 3F:
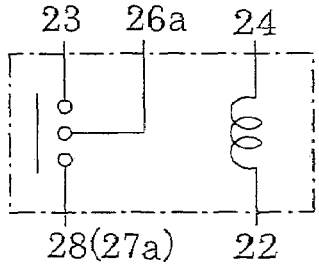
FIG. 3F is a circuit diagram of the electromagnetic relay having the one circuit and the gaps among three contacts shown in FIG. 3A.

FIGS. 3A to 3F disclose an electromagnetic relay 20 having one circuit and gaps among three contacts, as typically shown in FIG. 3F according to yet another embodiment of the present invention. The electromagnetic relay 20 is constituted as follows. First, second, and third terminals 26 are fixed to an insulation base 21 by means described with reference to the preceding embodiments. Fixed contacts 26*a* corresponding to the respective first, second, and third terminals 26 are provided at positions that generally form a triangle on an upper surface of the insulation base 21. A first movable plate 28 having movable contacts 27*a* provided at positions corresponding to two of the three fixed contacts 26*a*, respectively, is provided to coincide with a line that connects the fixed contacts 26*a*. A movable contact 27*a* corresponding to the other fixed contact 26*a* is provided in a central portion of a second movable plate 28' parallel to the first movable plate 28. The first movable plate 28 and the second movable plate 28' are fixed to a conductive pressing plate 37*a* exhibiting a conductive property and a spring property. In addition, the first movable plate 28 and the second movable plate 28' are attached to a movable spring 27 having both ends supported so that center lines of the movable plates 28 and 28' coincide with a center line of the movable spring 27. An armature 25 drives the conductive pressing plate 37*a* depending on whether or not a current is carried to a coil 23, thereby opening or closing the contact circuit.

FIGS. 8A to 8H disclose an electromagnetic relay 20 having one circuit and gaps among three contacts according to still another embodiment of the present invention. The electromagnetic relay 20 shown in FIGS. 8A to 8H is constituted as follows. First, second, and third terminals 26 are fixed to an insulation base 21, and fixed contacts 26*a* corresponding to the first, the second, and the third terminals 26 are provided at positions that generally form a triangle on an upper surface of the insulation base 21. Movable contacts 27*a* are provided at positions corresponding to the respective fixed contacts 26*a* on a movable plate 28 exhibiting a spring property. A first rib 38*a* is provided outside of the movable contacts 27*a* at the positions corresponding to two of the three fixed contacts 26*a* on the movable plate 28 so as to be parallel to a line that connects these two fixed contacts 26*a*. A second rib 38*b* is provided at a position outside of the movable contact 27*a* corresponding to the other fixed contact 26*a* on the movable plate 28 so as to be parallel to the first rib 38*a*. Bent portions 27*b* are provided on both sides of the movable plate 28, respectively, on this line so as to support both ends of the movable plate 28 and to hold the spring property of the movable plate 28. An armature 25 drives the movable plate 28 depending on whether or not a current is carried to a coil 23, thereby opening or closing a contact circuit. Protrusion edges 38*c* and 38*d* may be provided on the both ends of the movable plate 28 in place of the ribs 38*a* and 38*b*, respectively.

FIGS. 9A to 9F disclose the electromagnetic relay 20 constituted so that a center line of a movable plate 28 having movable contacts 27*a* provided to correspond to a line that connects two fixed contacts 26*a* and a center line of a movable spring 27 to which the movable plate 28 is attached are slightly offset inward in a range of a length equal to or smaller than a half of a contact diameter.

Figure 10A:
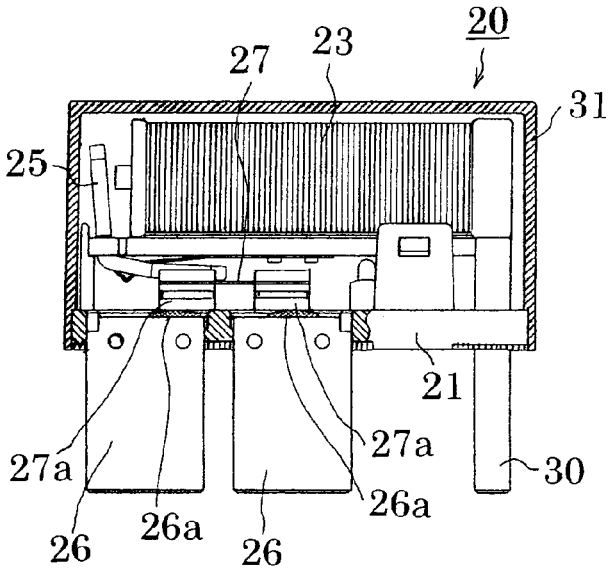
FIG. 10A is a longitudinal side view which shows terminal fixing means of the electromagnetic relay.
Figure 10B:
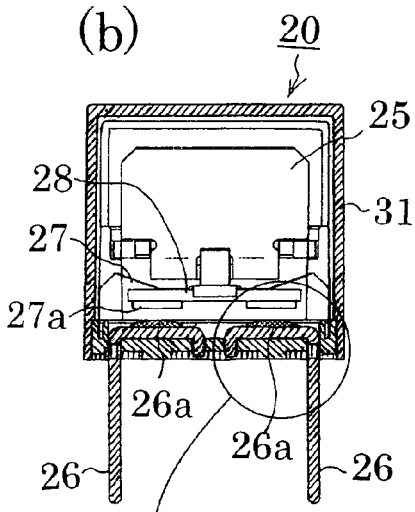
FIG. 10B is a longitudinal front view of FIG. 10A.
Figure 10C:
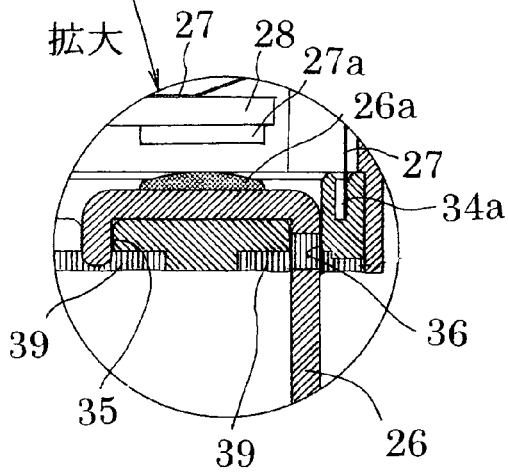
FIG. 10C is an enlarged view of a part in a circle shown in FIG. 10B.
Figure 11:
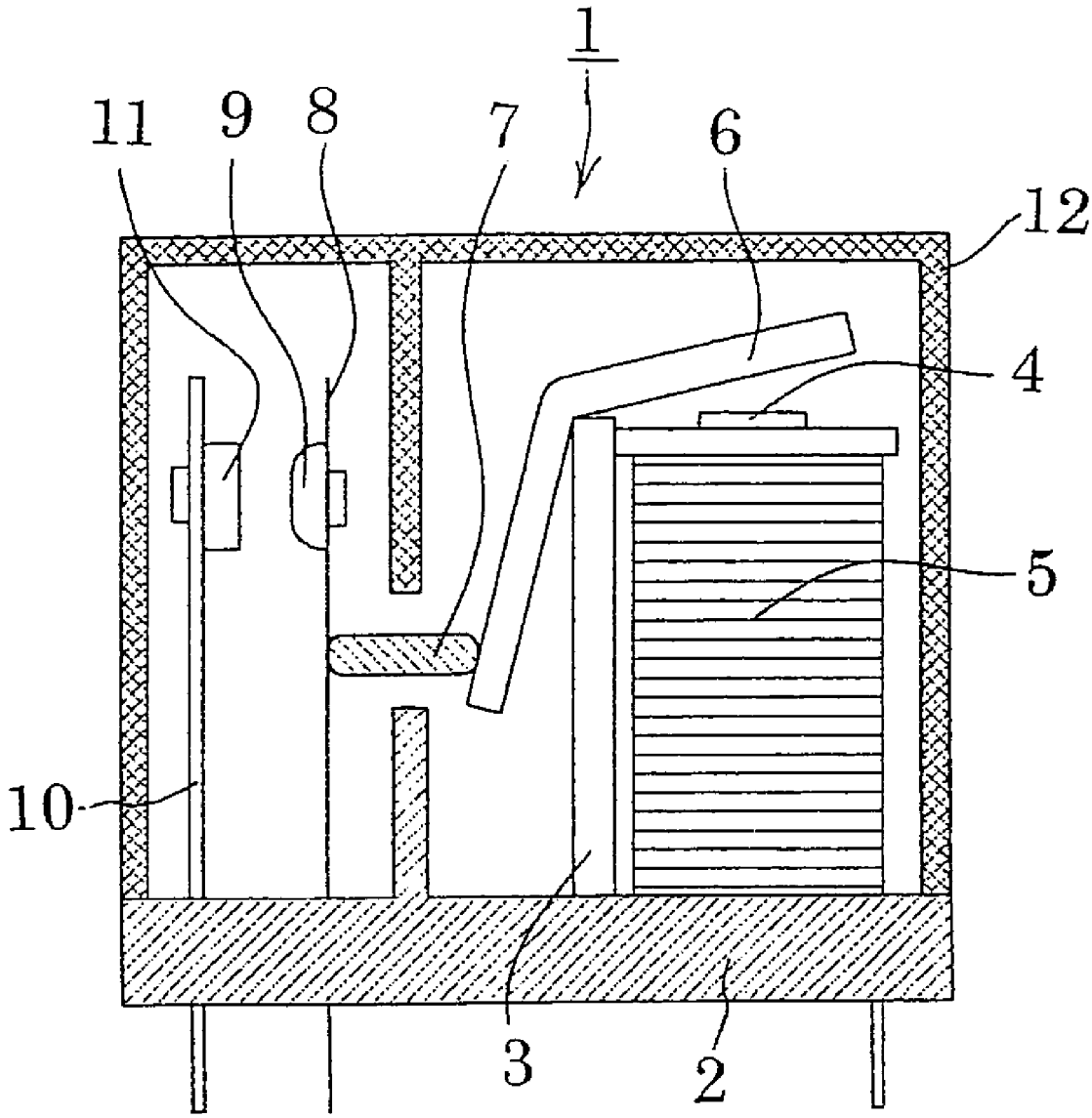
FIG.11 (Prior Art)
FIG. 11 is a longitudinal side view of a conventional electromagnetic relay.

The electromagnetic relay 20 shown in FIGS. 10A to 10C includes means for fixing the terminals 26 to the insulation base 21 Each terminal 26 is formed into the generally inverse concave having the long piece 26*b*, the short piece 26*c*, and the horizontal portion 26*d*. The horizontal portion 26*d* extends horizontally on the upper surface of the insulation base 21. The long piece 2 Gb is formed by bending one end of this horizontal portion 26*d* at a right angle so as to be pulled outside of the insulation base 21 as an external terminal. The short piece 26*c* is formed by bending the other end of the horizontal portion 26*d* at a right angle so as to be penetrated and inserted into the insulation base 21. At least one insertion hole (through hole) 36, which is exposed to the outside when the terminal 26 is inserted into the insulation base 21, is provided on the long piece 27 side of the terminal 26. After the long piece 26*b* of the terminal 26 is inserted into the insertion hole 36, an adhesive 39 is poured into the insertion hole 36, thereby fixing the long piece 26*b* of the terminal 26. Likewise, the adhesive 39 is poured into a portion of the insulation base 21 which is opposite to the insertion hole, and into which the short piece 26*c* is inserted and hardened. By doing so, a fixing strength of each terminal 26 and strength of the insulation base 21 are improved.

To reduce the internal resistance of the contact circuit, as the object of the present invention, it may be considered first to minimize a length of the internal circuit from one terminal 26 to the other terminal 26. To this end, when the terminals 26 are attached to the insulation base 21, the terminals 26 bent into the inverse concave are fixedly inserted into the insulation base 21 and the fixed contacts 26*a* are attached onto base upper surface-sides of the respective terminals. The movable contacts 27*a* are connected to the respective two fixed contacts 26 so as to short-circuit the two fixed contacts by bridging. It may be possible to constitute the circuit at a smallest length. In this case, the contacts may be arranged either in an equal direction to an armature operating direction or in a direction of a right angle with respect to the armature operating direction.

Providing that an axial direction of the coil 23 is a longitudinal direction of the insulation base 21, the armature operating direction normally corresponds to the axial direction. If the contacts are to be arranged in the axial direction, the movable contacts 27*a* can be provided at two points on the movable plate 28 of the spring 27 in the longitudinal direction so as to correspond to the respective fixed contacts 26*a*.

If the contacts are to be arranged in the right angle direction, the tip end of the movable plate 28 exhibiting the spring property in the longitudinal direction is formed into a T shape, and the movable contacts 27*a* can be provided on the T-shaped tip end to correspond to the respective fixed contacts 26*a*. In the latter arrangement, however, the tip end of the movable plate 28 is heavy to thereby disadvantageously generate a vibration. In the former arrangement, a synchronization characteristic for the two pairs of contacts is deteriorated. That is, it is disadvantageously difficult to simultaneously turn on or off the two pairs of contacts and damage may possibly concentrate on a specific side of the pairs.

Considering these disadvantages, according to the present invention, the electromagnetic relay 20 is constituted so that the movable spring 27 consists of a spring having both ends supported, the movable contacts 27*a* are attached to this movable spring 27, and the armature 25 drives the movable spring 27 at its intermediate position, thereby turning on or off the contacts. If the movable spring 27 is to be fixed to the insulation base 21, then the slits 34 insulated from the terminals 26 are formed and the both ends of the movable spring 27 are bent at the right angle so as to be inserted into the respective slits 34. Alternatively, the relatively large bent portions 27*b* may be provided on the both sides of the movable spring 27 so as to set a spring operation which ensures that the central portion of the movable spring 27 can be freely moved vertically and that an opening force of the contacts can be set.

By doing so, if the electromagnetic relay 20 is constituted so that contacts are always turned off, then the contact gap is set while the movable spring 27 to which the movable contact 27*a* is attached is located on the insulation base 21, a repulsive force of the movable spring 27 generated when the central portion of the spring 27 is forced down to close the contacts, can be set as the opening force of the contacts. The armature 25 forces down the movable spring 27 at the intermediate position between each of the two paired contacts and the fulcrum if the electromagnetic relay 20 has a one-pole configuration or at the intermediate position between each of the four paired contacts and the fulcrum if the electromagnetic relay 20 has a two-pole configuration, or forces down the movable plate 28 or the pressing plate 37 if the electromagnetic relay 20 has the other configuration. It is, therefore, possible to set a flexible amount (over-travel) after the contacts are open.

Further, by using beryllium copper having a low specific resistance as a material for the movable spring 27, the internal resistance of the contact circuit can be reduced.

If the electromagnetic relay 20 is constituted so that the contacts are always turned on, then each terminals 26 is inserted into the insulation base 21 while the movable spring 27 to which the movable contacts 27*a* are attached with the contacts 27*a* turned upward, the fixed contacts 26*a* are provided on the lower surfaces of the terminals 26 on the insulation base 21 so as to come in contact with the respective movable contacts 27*a*, the armature 25 forces down the central portion of the movable spring 27 through an insulator, and the contacts can be opened. Similarly to the above, by using beryllium copper having a low specific resistance as a material for the movable spring 27, the internal resistance of the contact circuit can be reduced.

If the resistance is to be further reduced, the two movable contacts 27*a* may be attached to the elastic plate 29 consisting of, for example, a copper plate thicker than the movable spring 27. A thickness of the elastic plate 29 can be set at, for example, 0.5 or 0.8 millimeter. An elastic force of the elastic plate 29 enables further reducing the internal resistance of the contact circuit, as compared with only use of the movable spring 27 having a restricted thickness. In this case, the movable plate 28 can be constituted by an inlay material having a contact material and a copper laminated (having two materials laminated) so as to be formed integrally with the contacts. If so, stainless steel having a high resistance can be used as a material for the movable spring 27.

Even if the thick movable plate 28 is used, the electromagnetic relay 20 is constituted to be able to perform the contact wipe. That is, the paired fixed contacts 26*a* arranged on a line are loosely fitted into the portions of the movable spring 27 that supports the movable plate 28 to which the movable contacts 27*a* corresponding to the fixed contacts 26*a* are attached, on one end of each of the columns 33 provided on the insulation base 21 on the extension orthogonal to this line, thereby constituting the fulcrums of the movable spring 27. The armature 25 drives the movable spring 27 at the intermediate between each of the fixed points of the movable plate 28 and the fulcrum on the columns 33, thereby opening or closing the contact circuit. After the fixed contacts 26*a* contact with the respective movable contacts 27*a*, the armature 25 forces down the movable spring 27. As a result, an inward flexion is generated between each movable contact 27*a* and each column 33, whereby a wipe operation is carried out in portions in which the two movable contacts 27*a* contact with the respective two fixed contacts 26*a*. If the movable plate 28 is attached to the movable spring 27, the pressing plate 37 exhibiting the spring property may be used between the columns 33. The pressing plate 37 is pressed and bent by the armature 25, whereby the wipe operation can be carried out in portions in which the two movable contacts 27*a* contact with the respective two fixed contacts 26*a*.

The electromagnetic relay 20 has been described above while referring to the one-pole configuration of the relay, that is, the relay having one circuit for brevity of description. The two-pole electromagnetic relay, that is, the electromagnetic relay having two circuits will now be described.

The two pairs of terminals 26, the two pairs of fixed contacts 26*a* each provided on one end of each terminal 26, and the two movable springs 27 each of which has the both ends supported and which support the movable contacts 27*a* at positions corresponding to the respective fixed contacts 26*a*, as described in the instance of the one-circuit configuration, are provided in parallel. The insulation pressing plate 37 is provided on the movable springs 27. The armature 25 drives the insulation pressing plate 37 depending on whether or not a current is carried to the coil 23, thereby simultaneously opening or closing the two contact circuits insulated from each other. That is, by driving the pressing plate 37 provided to serve as a bridge between the two contact circuits arranged in parallel and to insulate the two contact circuits from each other, the two pairs of contacts, i.e., the four contacts are simultaneously operated.

In this case, if the pressing plate 37 is constituted by the elastically deformed spring plate, the pressing plate 37 is bent by being forced down by the armature 25 after the fixed contacts 26*a* contact with the respective movable contacts 27*a*. In addition, the contacts are vertically moved, the movable plate 28 is inclined after the fixed contacts 26*a* contact with the respective movable contacts 27*a*, and the contact portions in which the fixed contacts 26*a* contact with the respective movable contacts 27*a* are slightly displaced. The wipe operation in the contact portions is thereby realized.

Means for attaching the movable spring 27 with the both ends supported will be described.

This movable spring 27 as well as the operation of the armature 25 driven by the electromagnetic coil drives the contact circuits. The opening force of the contacts is set by the spring 27, and the electromagnetic coil is required to have a driving force for forcing down the spring 27 at a predetermined contact pressure against this opening force.

Further, if the normally used cantilever spring in which a span between the fulcrum of the spring and the contact portion is long is used, the tip end of the spring tends to be displaced by a vibration or an impact generated when the contacts are open, depending on a weight and a weight balance of the spring since the open positions of the contacts are held by the opening force of the spring. As a result, a malfunction that the fixed contacts 26*a* contact with the respective movable contacts 27*a* although the relay is not driven by the electromagnetic coil occurs. According to the present invention, by contrast, the movable spring 27 with the both ends supported is used, and the contact circuits are opened by the movable contacts 27*a* attached to the movable plate 28 or the movable plate 28 to which the movable contacts 27*a* are attached. Because of the structure of supporting the both ends, the span between the fulcrum and the contact portion of the spring 27 is short. Further, because of the operation of the spring 27, it is possible to make it difficult to displace the tip end of the spring 27 by the vibration or the impact.

However, if the span is set too short, it is difficult to secure a sufficient displacement. Therefore, as shown in the drawings, the both ends of the movable spring 27 are inserted into the respective slits 34 that are formed in the portions vertical to the insulation base 21, and that are insulated from the terminals 26, and thereby fixed. The movable plate 27 provided with the movable contacts 27*b* is fixed to the displacement center of the movable spring 27, and the bent portions 27*b* are provided on the respective sides of the movable spring 27. The movable plate 28 can be moved by the flexible operations of the bent portions 27*b* while keeping the position of the movable plate 28 in parallel to the surface of the insulation base 21.

It is thereby possible to secure a sufficient displacement amount and lessen a burden on the spring. The electromagnetic relay having excellent durability of the spring and having good reliability can be, therefore, realized.

Furthermore, the both ends of this movable spring 27 can be fixed by the member, e.g., the yoke 22, constituting the electromagnetic driving block, by welding or by calking. If the movable plate 28 provided with the movable contacts 27*a* is fixed to the displacement center of the movable spring 27, and the bent portions 27*b* are provided on the both sides of the movable spring 27 so that the movable plate 28 can be moved in parallel to the surface of the insulation base 21, the same advantage can be attained. Further, since the electromagnetic driving block members can be simultaneously assembled, an assembly operation is, highly likely, improved.

The electromagnetic relay described so far is a so-called double gap relay of opening or closing one circuit using a gap between two contacts is constituted by one circuit (one pole) or two circuits (two poles). There is also a demand of an electromagnetic relay constituted so that gaps among three contacts are simultaneously opened or closed, that is, an electromagnetic relay corresponding to an equivalent of a star connection at a three-phase alternating current. A configuration of this electromagnetic relay will now be described.

The third terminal 26 is additionally fixed to the insulation base 21, and the fixed contacts 26*a* corresponding to the three terminals 26 are provided at the positions that generally form a triangle on the upper surface of the insulation base 21. The first movable plate 28 having the movable contacts 27*a* provided at positions corresponding to two of the three fixed contacts 26*a*, respectively, is provided to coincide with a line that connects the fixed contacts 26. The movable contact 27*a* corresponding to the other fixed contact 26*a* is provided in the central portion of the second movable plate 28 parallel to the first movable plate 28. The first movable plate 28 and the second movable plate 28 are fixed to the conductive pressing plate 37 exhibiting a conductive property and a spring property. In addition, the first movable plate 28 and the second movable plate 28 are attached to the movable spring 27 having both ends supported so that center lines of the movable plates 28 coincide with a center line of the movable spring 27. The armature 25 drives the conductive pressing plate 37 depending on whether or not a current is carried to a coil 23, thereby opening or closing the three fixed (six) contacts.

The two out of the three movable contacts 27*a* are attached to the movable plate 28 having a high rigidity, and the other one movable contact 27*a* is attached to another movable plate 28. Due to this, when the armature 25 forces down the pressing plate 37 after the contact circuit is open, the pressing plate 37 having the spring property is bent and the respective movable plates 28 are slightly inclined inward. The two movable contacts 27*a* attached to one movable plate 28 are offset toward a central side at a right angle with respect to the axial direction of the movable plate 28, and the movable contact 27*a* corresponding to the third fixed contact 26*a* is similarly inclined toward the central side at the right angle with respect to the axial direction of the movable plate 28. Therefore, the wipe operation can be carried in the portions in which the movable contacts 27*a* contact with the respective fixed contacts 26*a* so that the both movable plates 28 fall down inward.

In this case, the movable plate 28 exhibiting the spring property may be employed in place of the movable plate 28 and the pressing plate 37, and the ribs 38*a* may be provided on the movable plate 28. By doing so, the two movable contacts and the other one movable contact among the three movable contacts operate similarly to the two parallel movable plates 28.

Namely, the fixed contacts 26*a* corresponding to the first, the second, and the third terminals 26 are provided at positions that generally form a triangle on the upper surface of the insulation base 21. The movable contacts 27*a* are provided at positions corresponding to the respective fixed contacts 26*a* on the movable plate 28 exhibiting a spring property. The first rib 38*a* is provided outside of the movable contacts 27*a* at the positions corresponding to two of the three fixed contacts 26*a* on the movable plate 28 so as to be parallel to a line that connects these two fixed contacts 26*a*. The second rib 38*b* is provided at a position outside of the movable contact 27*a* corresponding to the other fixed contact 26*a* on the movable plate 28 so as to be parallel to the first rib 38*a*. The movable spring 27 with the both ends supported is provided in parallel to each of the ribs 38*a* and 38*b*, and the movable plate 28 is fixed to the movable spring 27 at least two points near the central portion thereof. The armature 25 drives the central portion of the movable plate 28 depending on whether or not a current is carried to a coil 23, thereby opening or closing the contact circuit.

Furthermore, the two movable plates 28 parallel to each other may be attached to the conductive plate formed into, for example, an H shape to thereby reduce a rigidity, and the pressing plate having the spring property may bridge over the conductive plate, and the armature 25 may force down the pressing plate, whereby the movable plates 28 can be driven.

To make the wipe operation clearer, the center line of the movable plate 28 having the movable contacts 27*a* provided to correspond to a line that connects the two fixed contacts 26*a* and the center line of the movable spring 27 to which the movable plate 28 is attached are slightly offset inward, preferably offset inward in a range of a length equal to or smaller than a half of a contact diameter. By doing so, when the armature 25 drives the movable spring 27, the movable plate 28, or the pressing plate 37, the wipe operation can be easily realized.

If the two center lines coincide, a point of application is present right on the point at which the contacts contact with each other. If the movement of the point of application is less influenced by bending but the center of the spring is offset from the center of the contact, the movement of the point of application is increased due to the bending, and the movement of the contact portion is increased, accordingly.

As described above, the present invention can realize the small-sized electromagnetic relay capable of reducing the internal resistance of the contact circuit as much as possible, and also capable of carrying a high current to the relay by the following advantages.

(1) By arranging the fixed contacts and the movable contacts at the smallest length, the internal resistance of the contact circuit can be reduced and the high current can be carried to the relay, accordingly. By forming the spring so that the both ends of the spring are supported, the electromagnetic relay of a structure having a high earthquake resistance and a high impact resistance can be provided.

(2) By providing the structure of short-circuiting the fixed contacts using the thick movable plate, the internal resistance of the contact circuit can be reduced, and the high current can be carried to the relay.

(3) Even if the thick movable plate is used, the both ends of the movable spring that supports this movable plate are supported by the columns and set as fulcrums. In addition, by using the extending movable spring, the contact wipe operation can be carried out, and a high durability and a good contact stability can be ensured.

(4) Even if the electromagnetic relay has the two-pole circuit configuration, the present invention can be applied to the relay by using two movable springs and providing the pressing plate for bridging over the two movable springs. By forming the pressing plate by a spring, the contact wipe operation can be carried out.

(5) By bending the both ends of the movable spring with the both ends supported, at the right angle with respect to the surface of the base and fixing the bent ends to the base, the movable spring can be easily assembled. In addition, by providing the bent portions around the bent ends, a sufficient displacement amount can be secured, and a burden on the spring can be lessened. Therefore, the electromagnetic relay advantageous in both durability and reliability of the spring can be provided.

(6) The movable spring with the both ends supported can fix the both ends to the yoke, the movable spring can be easily assembled, a sufficient displacement amount can be secured, and a burden on the spring can be lessened. Therefore, the electromagnetic relay advantageous in both durability and reliability of the spring can be provided.

(7) Even if the electromagnetic relay has the two-pole circuit configuration using two movable springs to which the movable plates are attached, the contact wipe operation can be carried out by providing the pressing plate having the spring property for bridging over the two movable springs.

(8) Even if the electromagnetic relay has the three-pole configuration of one circuit and gaps among three contacts, the relay can exhibit the same advantages as those of the one-pole electromagnetic relay and the two-pole electromagnetic relay by arranging the contacts to generally form a triangle, and by arranging and connecting the two movable plates to the pressing plate in parallel to each other.

(9) Even if the electromagnetic relay has the configuration in which one circuit and gaps among three contacts without using the movable plate, the electromagnetic relay can exhibit the same advantages at a low cost by providing the two parallel ribs to give a direction to the rigidity.

(10) To make the wipe operation clearer, the center line of the movable plate having the movable contacts provided to correspond to a line that connects the two fixed contacts and the center line of the movable spring to which the movable plate is attached are slightly offset inward, preferably offset inward in a range of a length equal to or smaller than a half of a contact diameter. By doing so, when the armature drives the movable spring, the movable plate, or the pressing plate, the wipe operation can be easily realized.

(11) If thick fixed terminals are attached to the small-sized relay to carry a high current to the relay, it is necessary to secure a sufficient strength of the terminals and a sufficient strength of the surface of the base that holds the terminals. Therefore, by forming the terminal structure into the structure described in the present invention, the strength of the resin base can be reinforced by the internal terminals and the fixing strength of the terminal can be simultaneously secured.

What is claimed is:

1. An electromagnetic relay comprising:

an electromagnetic driving block composed by a coil, an iron core, a yoke, and an armature; first, second, and third terminals fixed to a base;

fixed contacts provided at positions that generally form a triangle on an upper surface of the base;

a first movable plate having movable contacts provided at positions corresponding to two of the three fixed contacts, respectively, the first movable plate provided to coincide with a line that connects the two fixed contacts; and a movable contact corresponding to the other fixed contact, and provided in a central portion of a second movable plate parallel to the first movable plate, wherein the first movable plate and the second movable plate are fixed to a pressing plate exhibiting a conductive property and a spring property, the first movable plate and the second movable plate are attached to a movable spring having both ends supported by the base so that center lines of the movable plates coincide with a center line of the movable spring, and the armature drives the pressing plate depending on whether or not a current is carried to the coil, thereby opening or closing a contact circuit, whereby the pressing plate generates inward flexions in the movable spring and a wipe operation is carried out with respect to the fixed contacts and the movable contacts.

2. An electromagnetic relay comprising:

an electromagnetic driving block composed by a coil, an iron core, a yoke, and an armature; first, second, and third terminals fixed to a base;

fixed contacts provided at positions that generally form a triangle on an upper surface of the base;

a first movable plate having movable contacts provided at positions corresponding to two of the three fixed contacts, respectively, the first movable plate provided to coincide with a line that connects the two fixed contacts; and a movable contact corresponding to the other fixed contact, and provided in a central portion of a second movable plate parallel to the first movable plate, wherein the first movable plate and the second movable plate are fixed to a pressing plate exhibiting a conductive property and a spring property, the first movable plate and the second movable plate are attached to a movable spring having both ends supported by the base so that center lines of the movable plates coincide with a center line of the movable spring, the armature drives the pressing plate depending on whether or not a current is carried to the coil, thereby opening or closing a contact circuit, and wherein the center line of the first movable plate including the movable contacts provided to correspond to the line that connects the two fixed contacts and the center line of the movable spring to which the second movable plate is attached are slightly offset inward, preferably offset inward in a range of a length equal to or smaller than a half of a contact diameter, whereby the pressing plate generates inward flexions in the movable spring and a wipe operation is carried out with respect to the fixed contacts and the movable contacts.

3. An electromagnetic relay comprising:

a base;

an electromagnetic driving block having an armature held on said base;

three fixed contacts provided at positions that generally form a triangle on an upper surface of said base;

a first movable plate having movable contacts provided at positions corresponding to two of said three fixed contacts;

a second movable plate having a movable contact provided at a position corresponding to one of said three fixed contacts;

a movable spring attached to said first movable plate and said second movable plate, said movable spring having both ends supported by said base; and a pressing plate attached to said first movable plate and said second movable plate and positioned so that the armature drives the pressing plate depending on whether or not a current is carried to a coil, whereby when the armature drives said pressing plate, the armature forces down said pressing plate and the press ing plate generates inward flexions of said movable spring causing a wipe operation to be carried out.

4. An electromagnetic relay as in claim 3 wherein:

a center of each of said three fixed contacts is offset from a center of said movable contacts.

5. An electromagnetic relay as in claim 3 wherein:

said pressing plate is conductive.

6. An electromagnetic relay as in claim 3 wherein:

a bent end is formed on each end of said movable spring.

7. An electromagnetic relay as in claim 6 further comprising:

slits formed in said base adapted to receive the bent end formed on each end of said movable spring.

* * * * *